United States Patent [19]

Hiratsuka et al.

[11] Patent Number: 5,007,356

[45] Date of Patent: Apr. 16, 1991

[54] CUTTER ACTUATOR OF A BUTTON PERFORATING SEWING MACHINE

[75] Inventors: Katsuo Hiratsuka; Yoshiyuki Odaka; Takeshi Yoshida, all of Tochigi, Japan

[73] Assignee: SSMC Inc., Edison, N.J.

[21] Appl. No.: 374,808

[22] Filed: Jul. 3, 1989

[30] Foreign Application Priority Data

Jul. 26, 1988 [JP] Japan ..... 63-97940[U]

[51] Int. Cl.[5] ..... D05B 3/00

[52] U.S. Cl. ..... 112/68

[58] Field of Search ..... 112/65, 66, 67, 68, 112/129, 264.1

[56] References Cited

U.S. PATENT DOCUMENTS 1,048,786 12/1912 Allen ..... 112/68
1,136,388 4/1915 Allen ..... 112/68
1,179,378 4/1916 Allen ..... 112/68
1,807,577 5/1931 Allen ..... 112/68
2,174,294 9/1939 Spaine ..... 112/68
4,552,080 11/1985 Miyazaki ..... 112/68

FOREIGN PATENT DOCUMENTS 317693 8/1929 United Kingdom ..... 112/68

*Primary Examiner*—Werner H. Schroeder
*Assistant Examiner*—Paul C. Lewis
*Attorney, Agent, or Firm*—Theodore Jay

[57] ABSTRACT

A cutting actuator for a button perforating sewing machine enables sequence of various operating steps in a button perforating operation of sewn cloth to be changed under control of an operator.

The actuator employs a solenoid controlled arrangement wherein actuation of the solenoid selects one sequence while deactuation of the solenoid selects another sequence.

4 Claims, 4 Drawing Sheets

CUTTER ACTUATOR OF A BUTTON PERFORATING SEWING MACHINE

BACKGROUND OF THE INVENTION

1. Field of the Invention:

There are two types of button perforating sewing machines. The first type perforates cloth in an earlier step (hereinafter referred to as earlier perforation type). The second type perforates cloth in a later step (hereinafter referred to as later perforation type).

The present invention relates to a cutter actuator for a button perforating sewing machine which can function as either the first type or the second type machine.

2. Description of Prior Art:

One cycle of a series of successive perforating operations in the earlier perforation type machine comprises "SEWN CLOTH CLAMPING STEP", "BUTTON PERFORATING STEP", "CLOTH TENSIONING STEP", "FIRST FEEDING STEP", "SEWING STEP", "SECOND FEEDING STEP", and "SEWN CLOTH CLAMPING AND RELEASING STEP". One cycle in the later perforation type machine comprises "SEWN CLOTH CLAMPING STEP", "CLOTH TENSIONING STEP", "FIRST FEEDING STEP", "SEWING STEP", "SECOND FEEDING STEP", "BUTTON PERFORATING STEP", and "SEWN CLOTH CLAMPING AND RELEASING STEP".

The earlier perforation type differs from the later perforation type with respect to the order or the position of "BUTTON PERFORATING STEP" in the cycle.

"BUTTON PERFORATING STEP" in the prior art later perforating type machine will be described with reference to FIG. 6.

As shown in FIG. 6, a kick plate shaft 100 secured to a gear rotatable for one revolution at one cycle is turned in the direction of the dotted arrow a at the last stage of the cycle (SECOND FEEDING STEP) thereby pushing a pin 104 of a kick plate 103. As a result, a kick plate carrier 1 integrated with the kick plate 103 is rotated, causing a cutting actuator lever 8 connected to a kick plate carrier shaft 2 to swing in the direction shown by arrow F.

"BUTTON PERFORATING STEP" of the prior art earlier perforation type machine is shown in FIGS. 4, 5. As shown in these Figures, a cutting actuator lever kick plate 101 is fixed to the closing lever 22 which operates during the "SEWN CLOTH CLAMPING STEP". Upon swinging movement of the closing lever 22 about the axis of E—E', a projection 102 of the cutting actuator lever 101 pushes the cutting actuator arm 25' (refer to FIG. 5) while the cutting actuator lever 8 is turned in the direction of the arrow F.

In either case, the invention shown in FIG. 2 employs the swinging movement of cutting actuator lever 8 in the direction of F, causes block 9 to be disengaged from a right projection **10*a* of clutch 12 slidably attached to a cutting driven wheel 15 while clutch 12 is urged by a spiral spring 11 to move radially. A left projection 10*b* of the clutch 12 is connected to one of the cutting wheel blocks 13 fixed to an inner peripheral surface of a cutting wheel 14 which is always rotated beside the cutting driven wheel 15. As a result, the cutting driven wheel 15 starts to rotate together with the cutting driving wheel 14. With the rotation of the cutting driven wheel 15, the cutting driven wheel 15 and a pair of cams 16, 16' connected to the driven wheel 15 via a cutting axis G—G' are rotated thereby causing a pair of cutting arms 17, 18 to swing whereby a woven cloth 31 is subjected to the button perforating operation by a block 20 and a knife 19 secured to one end of the pair of cutting arms 17, 18**.

When one sewing machine is to function either as an earlier type machine or as a later type machine, a plurality of switching operations are required. That is, if the earlier perforation type is switched to the later perforation type, it was necessary to engage the kick plate carrier shaft 2 with the cutting actuator lever 8 by actuating a holder (not shown) which slightly moves upward the cutting actuator kick plate 101 so that the projection 102 of the cutting actuator lever kick plate 101 does not push the cutting actuator arm 25' while the knife 19 is operated at the operation timing of the earlier perforation type in a first "SEWN CLOTH CLAMPING STEP" in one cycle operation. Namely, in a substantially last step of the earlier perforation type, the kick plate carrier shaft 2 is pulled forwardly to be drawn into the kick plate carrier 1 in order that a cutting actuator lever plate 7 is not operated even if the kick plate shaft 100 operates the kick plate 103 while the swinging movement of the kick plate carrier shaft 2 is not delivered to the cutting actuator lever 8.

In the case of switching from the later perforation type to the earlier perforation type, an operation as reversed to the switching from the earlier perforation type to the later perforation type is required.

Thus, in order to provide the single sewing machine with both earlier and the later perforation type functions it is necessary to deal with various problems. In the first place, the structure is complex since both the cutting actuator lever kick plate 101 and the kick plate carrier shaft 2 are drivable. Secondly, the switching operation between the earlier perforation type and the later perforation type is troublesome. Thirdly, there is a risk that the sewn cloth 31 and the sewing machine can be damaged should an operator forget to carry out the switching operation between the earlier perforation type and the later perforation type.

SUMMARY OF THE INVENTION

The present invention has been made to overcome the problems described above.

It is therefore an object of the present invention to provide a cutter actuator for a button perforating sewing machine which can function either as an earlier perforation type machine or as a later perforation type machine.

It is another object of the present invention to provide a cutter actuator for a button perforating sewing machine which is capable of being changed from an earlier perforation type machine to a later perforation type or vice versa with ease and simplicity.

It is a further object of the present invention to provide a cutter actuator for a perforating sewing machine capable of automatically effecting "BUTTON PERFORATING STEP" with ease by mere shifting from the earlier perforation type to the later perforation type or vice versa thereby eliminating in advance of use any subsequent damage to the machine and to the sewn cloth.

To achieve the above objects, the cutter actuator of a button perforating sewing machine comprises a cutting driving wheel rotatably supported by a body of the button perforating sewing machine. A cutting driven wheel is arranged rotatably and positioned coaxially with the axis of the cutting wheel for permitting the driven wheel to engage the cutting wheel or disengage the driven wheel from the cutting wheel. A cutting actuator lever is supported movably by the body of the button perforating sewing machine. This lever is movable either to an operative position where the cutting driven wheel is engaged with the cutting wheel or to an inoperative position where the cutting driven wheel is disengaged from the cutting. First and second cams are respectively secured to a cutting axis and are rotatable together with the cutting driven wheel when the cutting driven wheel is engaged with the cutting driving wheel. A first cutting arm, swingable about an axis parallel to the cutting axis, has a knife at one end thereof and at the other end is engaged with the first cam. A second cutting arm, swingable about an axis parallel to the cutting axis, has a block at an end thereof and the other end is engaged with the cam. A drive means is provided for moving the cutting actuator lever to the operative position.

The above and other objects, features and advantages of the present invention will become more apparent from the following description taken in conjunction with the accompanying drawings.

PREFERRED EMBODIMENT OF THE INVENTION

Figure 1:
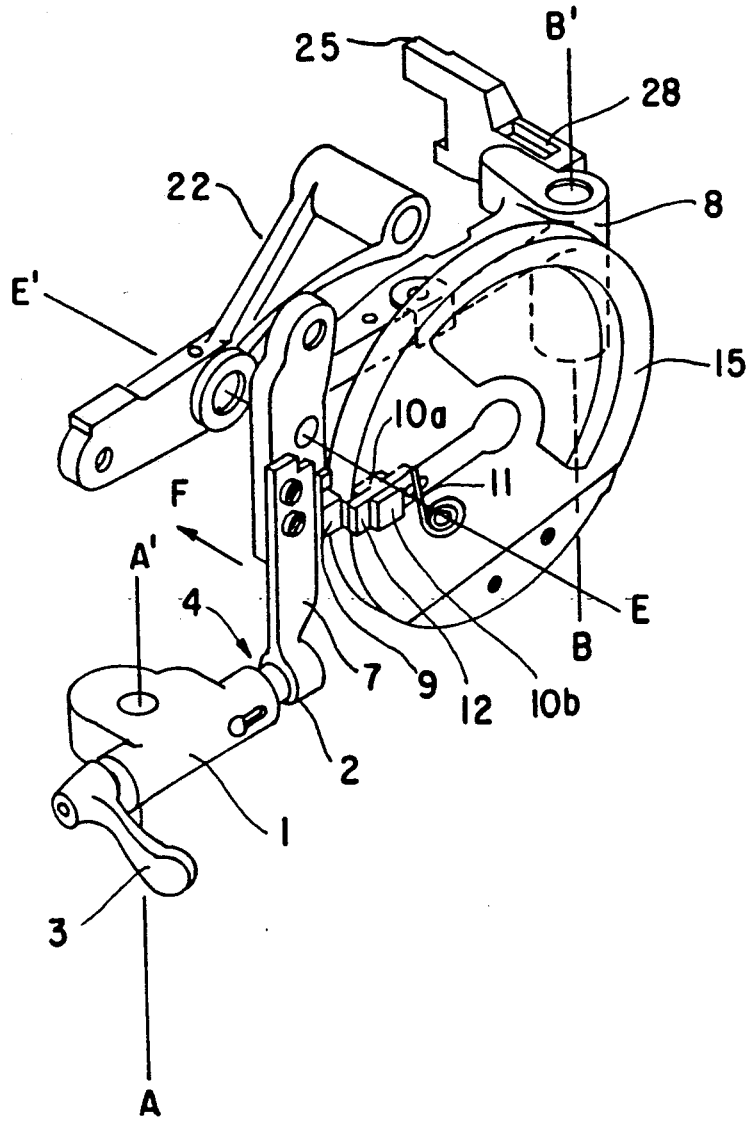
FIG. 1 is a perspective view showing a main portion of a button perforating sewing machine in accordance with a preferred embodiment of the present invention.
Figure 2:
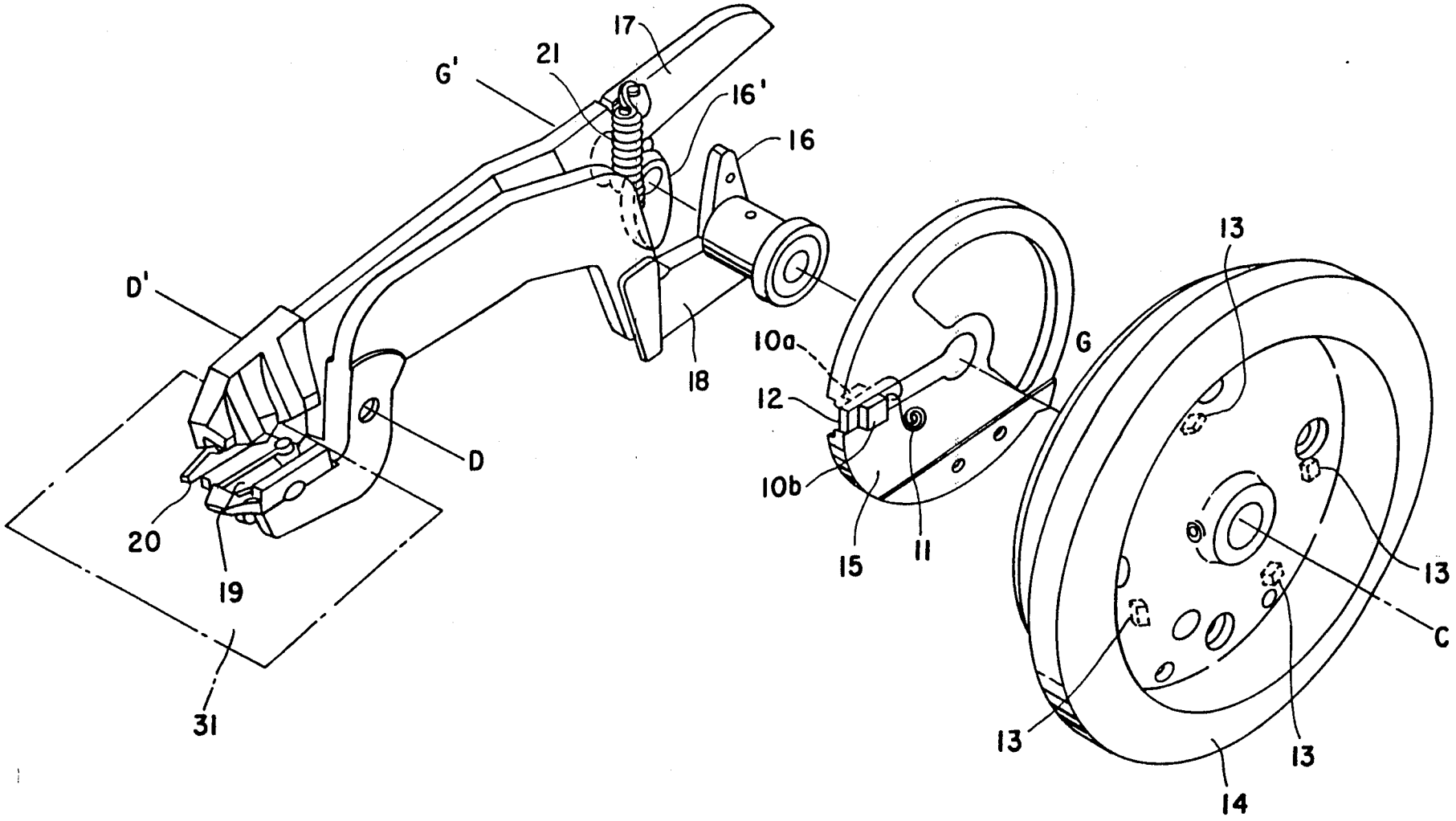
FIG. 2 is an exploded perspective view of a cutting wheel, a cutting driven wheel, and a cutting arm, as employed in the present invention.
Figure 3:
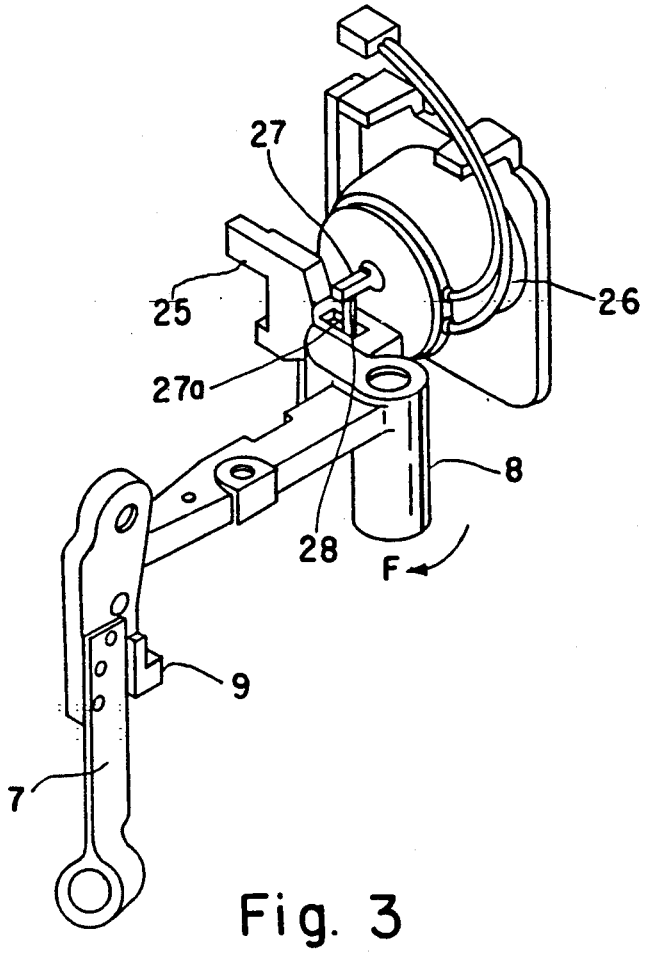
FIG. 3 is a perspective view showing a cutting actuator lever and a solenoid as employed in the present invention.
Figure 4:
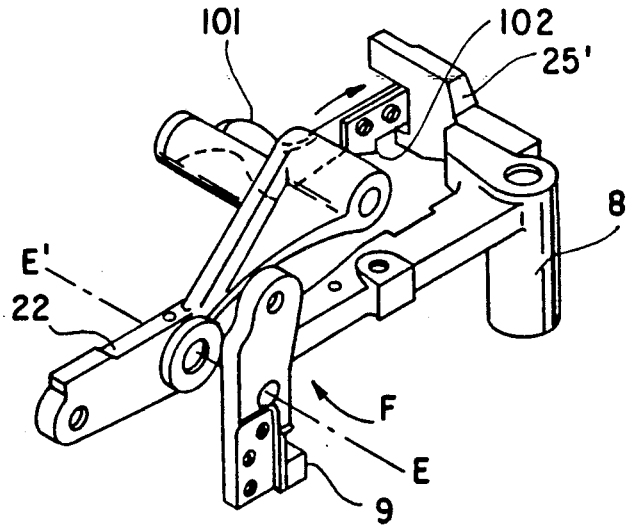
PRIOR ART Fig. 4
FIG. 4 is a perspective view of a prior art cutting actuator lever and a closing lever used in an earlier perforation type machine.
Figure 5:
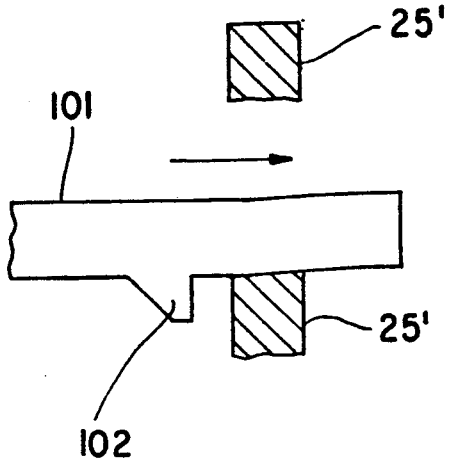
PRIOR ART Fig. 5
FIG. 5 is another view of the structure of FIG. 4.
Figure 6:
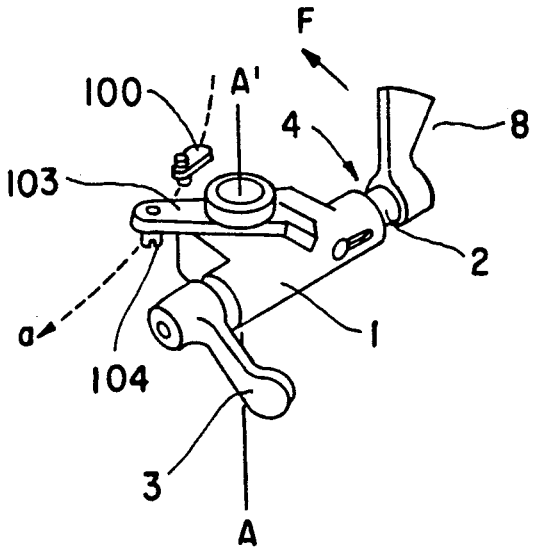
PRIOR ART Fig. 6
FIG. 6 is a perspective view showing a prior art kick plate carrier used on a later perforation type machine.

Referring now to FIGS. 1-3, a cutter actuator of a perforating sewing machine comprises a cutting wheel 14 rotatably supported by a body of a button perforating sewing machine. A cutting driven wheel 15 is arranged rotatably and is positioned coaxially with the axis of the cutting wheel 14. A clutch 12 is disposed at the cutting driven wheel 15 to engage the cutting wheel 14 or to disengage the driven wheel 15 from the cutting wheel 14. A cutting actuator lever 8 is supported movably by the body of the perforating sewing machine and is movable either to an operative position where the cutting driven wheel 15 is engaged with the cutting wheel 14 or to an inoperative position where the cutting driven wheel 15 is disengaged from the cutting wheel 14. First and second cams 16, 16' are respectively fixed to a cutting axis G—G' and are rotatable together with the cutting driven wheel 15 when the cutting driven wheel 15 is rotated at the time when the cutting driven wheel 15 is engaged with the cutting wheel 14. A first cutting arm 18, swingable about an axis D—D' parallel to the cutting axis G—G', has a knife 19 at one end thereof and at the other end engaged with the first cam 16. A second cutting arm 17, swingable about the cutting axis D—D' parallel to the cutting axis G—G', has a block 20 at one end thereof and is engaged at the other end with the cam 16'. Drive means 26 moves the cutting actuator lever 8 to the operative position.

Each element of the cutter actuator of a button perforating sewing machine will now be described more in detail.

A kick plate carrier 1 swingably supported by an axis A—A' which extends vertically from the body of the sewing machine (hereinafter referred to as body) has a kick plate carrier shaft 2 slidable forward and backward. The kick plate carrier shaft 2 is swingable about the axis A—A' by pushing or pulling a cutting handle 3 fixed to an end of the kick plate carrier shaft 2 in front of the kick plate carrier 1. A cutting actuator lever 7 has one end swingably connected to an end of the kick plate carrier shaft 2 via a ball joint 4 and has the other end connected to an end of a cutting actuator lever 8. The cutting actuator lever 8 is supported by an axis B—B' and is swingable about the axis B—B' which extends vertically from the body.

The cutting driven wheel 15 is secured to the cutting axis G—G' which is rotatably supported by the body and extends right and left as shown in FIG. 2. The cutting driven wheel 15 is rotated for one revolution together with the cutting axis G—G' at the time of "BUTTON PERFORATING STEP", namely, at the time of perforating a button hole in a sewn material 31 so that the material 31 is subjected to a cutting operation. The cutting driven wheel 15 has a clutch 12 capable of sliding in a radial direction thereof. The clutch 12 has a projection **10*a* projected at the right side of the body and a projection 10*b* projected at the left side. The projection 10*a* is held by a block 9 fixed to the cutting actuator lever 8 at an inclined surface thereof together with the actuator lever plate 7 for pushing the clutch 12 inside in the radial direction and disengaging the projection 10*b* from a plurality of cutting wheel blocks 13 of the cutting wheel 14 to prevent the rotation of the cutting driven wheel 15. The clutch 12 is always urged by a spiral spring 11 in the outward and radial direction. The first and the second cams 16*b*, 16*b'*** are fixed to the cutting shaft G—G'.

The cutting arms 17, 18 are respectively swingable by the pair of cams 16, 16' fixed to the cutting axis G—G' when the cutting axis G—G' is rotated for one revolution in "BUTTON PERFORATING STEP" to permit the block 20 and the knife 19 to carry out the button perforating operation. The cutting arms 17, 18 always contact the pair of cams 16, 16' because of the action of a return spring 21 which extends between both cutting arms 17, 18.

The cutting wheel 14 is attached to the axis C—C' coaxial with the axis G—G' for driving the cutting driven wheel 15 and is always rotated. A plurality of cutting wheel blocks 13 are fixed to the cutting wheel 14 (four cutting wheel blocks in this embodiment) in a predetermined spaced interval at the inner circumferential periphery of the cutting wheel 14.

A closing lever 22 is swingable attached to the body about an axis E—E' parallel with the cutting axis G—G'.

The drive means is composed of a solenoid 26 attached to the body for swingably driving a cutting actuator lever arm 25 projected from the cutting actuator lever 8. The solenoid 26 has a shaft or core 27 provided with a pin **27*a* attached to the end thereof which projects downwardly therefrom. The cutting actuator lever arm 25 has at the upper surface thereof a groove 28 extending right and left in which the pin 27***a* is engaged.

An operation of the cutter actuator of the button perforating sewing machine is described below.

When the perforating sewing machine of the present invention is to be used as the earlier perforation type, since the button perforating cycle of the earlier perforation type comprises "SEWN CLAMPING STEP", "BUTTON PERFORATING STEP", "CLOTH TENSIONING STEP", "FIRST FEEDING STEP", "SEWING STEP", "SECOND FEEDING STEP", and "SEWN CLOTH CLAMPING AND RELEASING STEP", the solenoid 26 is energized to pull the shaft 27 at the time of completion of "SEWN CLAMPING STEP", namely, at the time when the closing lever 22 swings downwardly in FIG. 1 to clamp the sewn cloth 31. The pin 27*a* of the shaft 27 slides in the groove 28 to swing the cutting actuator lever arm 25 or cutting actuator lever 8 so that the cutting actuator lever 8 moves to an operative position, namely, in the direction of the arrow F. The button perforating operation can be effected thereafter. That is, the block 9 of the cutting actuator lever 8 is disengaged from the projection 10*a* of the clutch 12 which is slidably attached to the cutting driven wheel 15 so that the clutch 12 is moved radially outwardly by the spiral spring 11. As a result, the left projection 10*b* of the clutch 12 is engaged with one of the cutting wheel blocks 13 to permit the driven wheel 15 to rotate together with the cutting wheel 14. Upon the actuation of the rotation of the cutting driven wheel 15, the first and the second cams 16, 16' connected to the cutting driven wheel 15 and the cutting axis G—G' are rotated thereby swinging the first and the second cutting arms 17, 18. As a result, the button hole is prepared in the sewn cloth 31 by the knife 19 and the block 20 attached to the first and the second cutting arms 18, 18'. If a limit switch (not shown) detects a downward swingable movement of the closing lever 22 at the time of "SEWN CLOTH CLAMPING STEP" to drive the solenoid 26 on the basis of a detected signal, "BUTTON PERFORATING STEP" can be automatized.

The arrangement of the cutter actuator of the button perforating sewing machine according to the preferred embodiment of the present invention achieves the following advantages.

In the first place, the "BUTTON PERFORATING STEP" can be effected at an appropriate step in the series of steps by merely swinging the cutting actuator lever to the operative position so that the functions of earlier and the later perforation type machines can be interchanged with ease and simplicity.

Secondly, the "BUTTON PERFORATING STEP" can be automatized with ease.

Thirdly, "BUTTON PERFORATING STEP" can be effected in the appropriate step in the successive operations by a mere shifting from the earlier perforation type function to the later perforation type function or vice versa thereby preventing in advance damage to the sewing machine and the sewn cloth.

Fourthly, inasmuch as the cutting actuator is a simple structure, the reliability of the button perforating sewing machine can be improved.

Fifthly, since "BUTTON PERFORATION STEP" can be omitted without actuation of the driver, the button perforating sewing machine of the present invention can be applicable to the stitching of the sewn material without perforating the button hole such as an imitation button hole.

Although the invention has been described in its preferred form with a certain degree of particularity, it is to be understood that many variations and changes are possible in the invention without departing from the scope thereof.

What is claimed is:

1. A cutting actuator adapted for use on a button perforating machine, said actuator comprising:

a first wheel supported on said machine and continuously rotated about an axis;

a second wheel rotatable about said axis;

a clutch disposed adjacent the first and second wheels, the clutch having a first clutch position wherein said first wheel engages the second wheel and causes the second wheel to be driven by and rotated with the first wheel, the clutch having a second clutch position wherein the first and second wheels are disengaged and the second wheel does not rotate;

a cutting actuator lever supported on the machine and coupled to the clutch, the lever having a first lever position wherein the clutch is placed in the first clutch position and the second wheel is rotated, the lever having a second lever position wherein the clutch is placed in the second clutch position and the second wheel does not rotate;

solenoid means coupled to the lever, said solenoid means when actuated placing the lever in the first lever position and when deactuated placing the lever in the second lever position;

a first elongated cutting arm having a knife at one end;

a second elongated cutting arm having a block at one end; and cam means coupled to the first and second arms, said cam means coupled to the second wheel and responsive to rotation of the second wheel to move the knife and block into button hole forming position with respect to any sewn material disposed between the knife and block, said cam means when the second wheel does not rotate moving the knife and block out of button hole forming position.

2. The actuator of claim 1 wherein the second wheel has a plurality of cutting blocks and the clutch has a projection engaged with one of the cutting blocks when the clutch is in the first clutch position and disengaged from the cutting block when the clutch is in the second clutch position.

3. The actuator of claim 2 wherein the solenoid means includes a shaft with a pin secured thereto.

4. The actuator of claim 3 wherein the lever has an arm with a groove, the pin engaging the groove when the solenoid is actuated.

* * * * *